US008176689B1

(12) United States Patent
Thompson

(10) Patent No.: US 8,176,689 B1
(45) Date of Patent: May 15, 2012

(54) RETROFIT HURRICANE-EARTHQUAKE CLIPS

(76) Inventor: Thomas C Thompson, Makakilo, HI (US)

( * ) Notice: Subject to any disclaimer, the term of this patent is extended or adjusted under 35 U.S.C. 154(b) by 0 days.

(21) Appl. No.: 12/151,763

(22) Filed: May 7, 2008

(51) Int. Cl.
*E04B 7/04* (2006.01)
*E04B 1/38* (2006.01)
*E04C 5/00* (2006.01)

(52) U.S. Cl. ..... 52/92.1; 52/92.2; 52/93.1; 52/702

(58) Field of Classification Search ..... 52/92.2, 52/289, 702, 92.1, 93.1, 167.1, 167.3; 403/232.1, 403/189, 190
See application file for complete search history.

(56) References Cited

U.S. PATENT DOCUMENTS 1,342,659 A * 6/1920 Wright ..... 248/292.12
1,657,243 A * 1/1928 Daniels ..... 403/190
2,321,221 A * 6/1943 Linehan ..... 403/230
2,413,362 A * 12/1946 Maxwell et al. ..... 403/403
3,091,822 A * 6/1963 Fiekers et al. ..... 403/394
3,184,800 A * 5/1965 Nelson ..... 403/219
3,667,786 A * 6/1972 Cooper ..... 403/384
4,498,801 A * 2/1985 Gilb ..... 403/232.1
4,714,372 A * 12/1987 Commins ..... 403/400
4,896,985 A * 1/1990 Commins ..... 403/11
5,109,646 A * 5/1992 Colonias et al. ..... 52/712
5,150,982 A * 9/1992 Gilb ..... 403/232.1
5,311,708 A * 5/1994 Frye ..... 52/90.1
5,341,619 A * 8/1994 Dunagan et al. ..... 52/702
5,448,871 A * 9/1995 Newman et al. ..... 52/712
5,560,156 A * 10/1996 McDonald ..... 52/92.2
5,561,949 A * 10/1996 Knoth ..... 52/92.2
5,732,524 A * 3/1998 Kalker et al. ..... 52/712
6,240,682 B1 * 6/2001 James et al. ..... 52/90.2
6,295,780 B1 * 10/2001 Thompson ..... 52/712
6,295,781 B1 * 10/2001 Thompson ..... 52/712
6,324,810 B1 * 12/2001 Thompson ..... 52/713
6,474,037 B2 * 11/2002 Thompson ..... 52/713
6,484,468 B2 * 11/2002 Thompson ..... 52/511
6,490,840 B1 * 12/2002 Thompson ..... 52/715
6,510,666 B1 * 1/2003 Thompson ..... 52/712
6,655,096 B1 * 12/2003 Pryor ..... 52/92.2
6,662,517 B1 * 12/2003 Thompson ..... 52/714
6,718,698 B1 * 4/2004 Thompson ..... 52/92.2
6,751,920 B2 * 6/2004 Thompson ..... 52/712
6,763,634 B1 * 7/2004 Thompson ..... 52/92.2
6,877,284 B2 * 4/2005 Thompson ..... 52/112
6,931,799 B2 * 8/2005 Webb ..... 52/167.1
7,134,252 B2 * 11/2006 Thompson ..... 52/712
7,334,372 B2 * 2/2008 Evans et al. ..... 52/289
D618,085 S * 6/2010 Lin et al. ..... D8/354
7,805,894 B2 * 10/2010 Contasti ..... 52/98
7,886,494 B1 * 2/2011 Schott ..... 52/489.1
2002/0069607 A1 * 6/2002 Thompson ..... 52/702

* cited by examiner

*Primary Examiner* — Jessica Laux
*Assistant Examiner* — Andrew Triggs

(57) ABSTRACT

Retrofit hurricane and earthquake clips for connecting a roof to a wall. The connectors include a plate web and rafter web, connected by a modified right-angle bend. For added strength in the right angle bend, wavy edges add material into the bend. Multiple bends add strength and material to the right angle bends, and place the rafter web perpendicular to the plate web. A ledge allows the connector to clear frieze boards. The wide plate webs attach to the outside wall sheathing and underlying top plate to prevent bowing out of the wall and lateral movement. The rafter webs attach to the side of a rafter to prevent uplift, outward thrusting, and twisting. The material added to the connection between the rafter web and plate web strengthens a building against strong winds and seismic events.

6 Claims, 17 Drawing Sheets

RETROFIT HURRICANE-EARTHQUAKE CLIPS

CROSS-REFERENCE TO RELATED APPLICATIONS

Not Applicable.

FEDERALLY SPONSORED RESEARCH

Not Applicable.

SEQUENCE LISTING OR PROGRAM

Not Applicable.

BACKGROUND OF THE INVENTION

Field of Invention

This invention relates to innovative retrofit connectors that permanently connect the roof to the outside wall to create buildings that are stronger and more resistant to hurricanes and earthquakes.

Recent studies of hurricane damage on wood-frame buildings indicate that extensive damage was generated to a house by strong winds, when the roof rafters or roof trusses twisted or were torn from the outside wall.

Roof sheathing ties all the rafters or purlins together on a wood frame house, and the roof sheathing ties all the roof trusses together when a masonry or wood-frame house is constructed with trusses. If the rafters or trusses rack or twist from the wind forces, the roof sheathing can detach from the roof allowing rain to enter the house.

Failure of the outside wall sheathing is common during hurricanes, because of inadequate fastening of the sheathing to the underlying structural members. This invention helps prevent the wall sheathing from splitting, racking, and detaching from the wall. The extreme negative pressure of a hurricane blows out the sheathing from walls, but this invention holds the sheathing tight to the walls, as sheet metal joints perform better than nailed joints in high winds and during seismic activity.

Studies of damage after Hurricane Andrew show several problems with the attachment of roof rafters and roof trusses that this invention solves.

Roof overhangs act like wings, creating huge uplifting forces during strong winds. This uplift tears apart the rafters that are toe-nailed to the header or top plate. The uplift can also twist rafters and roof trusses weakening the toenailed connections and causing detachment of the roof to the walls.

The one thing that ties together the top plate, studs, and sill plate is the outside sheathing. This invention effectively ties together the rafter, top plate, and outside wall sheathing to form a continuous load-path to the sill plate. Attaching my invention to the rafter and top plate junction puts the nails perpendicular to the uplifting force and would require shearing the nails in order to lift the rafter or truss.

One significant factor in building construction is precision framing, where the rafter is installed directly above the stud. Unfortunately, in existing houses this is rarely the case.

Post-and-beam construction is very common in older homes in mild-weather areas, and we have found that the wall studs, or in this case, posts, are only under every fourth rafter, and the rafters can be 4-feet on center. Usually, the posts are directly under where the top plate butts up against the top plate in the run. The rafter is to one side of this butt joint, so the rafter does not line up directly over the post.

On newer stud-wall construction, we have seen that studs rarely line up directly under the rafters. We saw houses where the walls have studs 16-inches on center, constructed with a roof that had rafters 24-inches on center. This means the only rafter and stud that will line up to form a continuous load-path is every fourth stud or every other rafter. The odds are low that they will exactly line up.

Another problem with home construction is on mis-installation of prior art hurricane clips that are made for new construction and covered by wall sheathing. After Hurricane Andrew, there were many examples of careless and inferior attachment of hurricane clips or they were entirely missing. One company has visited new construction sites and documented many examples of shoddy and incorrect application of their products.

To achieve a continuous load-path on existing houses the outside sheathing must be taken into account. The most important tie in an existing house is between the rafter and top plate or roof truss and top plate. Any uplifting wind force on the roof must be transferred to the walls. In tropical climates, the roof purlin, an intermediate structural member, may separate from the rafter with the roof sheathing.

My invention effectively ties together the rafter or roof truss, top plate, and outside sheathing (and indirectly, the wall studs) to form the most practical and economical continuous load path from the roof to the foundation.

During an earthquake, the floor, wall, and roof diaphragms undergo shearing and bending. Because of the difference in weight, a roof can move at different speeds than the walls. The shear forces from the roof boundary members are transferred to the top of the shear wall by way of toenails to the top plate. To withstand and transfer the shear loads, the connection between the roof and wall must be strong.

The outside sheathing provides lateral stability to the walls, preventing racking. The sheathing also absorbs and transfers earthquake forces by becoming a shear wall.

An earthquake can send motion into a house and separate the sheathing from the walls. The sheathing can come loose from the walls by the nails popping out or the plywood splitting away from the nails driven on it's edge. Some codes allowed sheathing to be stapled to the wall studs, which is a weak connection. This invention helps prevent the outside sheathing from pulling away from the wall during earth movements.

Steel connectors, between different components of a wood-frame buildings superstructure, provide continuity so that the building will move as a unit in response to seismic activity. This invention ties the walls securely to the roof, so the house will move as one unit.

BACKGROUND OF THE INVENTION

Prior Art

A number of connectors have been developed to tie together the structural members of a house under construction. They have always been thin and weak in order to fit under the outside sheathing or inside wall gypsum. Up until this invention, the only other retrofit hurricane clips were U.S. Pat. Nos. 6,490,840 B1, 6,662,517 B1, and 6,763,634 B1, all by Thompson.

The leading manufacturer of wood construction connectors, the Simpson Strong-tie Company, shows no retrofit hurricane connectors in their catalog. They do have a variety of connectors for use in new construction that ties the rafter to the top plate including: H1, H2, H2.5, H2.5A, H2.5T, H3, H4, H5, H6, H7Z, H8, H10, H10-2, H10S, H14, H15, H16, and H24. None are retrofit or tie the wall sheathing to the wall.

There are a number of ties that fasten the rafter to the top plate while a house is being constructed including: Knoth U.S. Pat. No. 5,561,949, McDonald U.S. Pat. No. 5,560,156, Colonias U.S. Pat. No. 5,380,115, Stuart U.S. Pat. No. 5,335,469, Callies U.S. Pat. No. 5,230,198, Colonias et at U.S. Pat. No. 5,109,646, Commins U.S. Pat. No. 4,714,372, Gilb U.S. Pat. No. 4,572,695, Gilb et at U.S. Pat. No. 4,410,294, and Maxwell et al U.S. Pat. No. 2,413,362.

These are good inventions, but they are difficult to retrofit onto existing houses without demolition of existing parts on a house. None were designed or patented to be retrofit on installed onto an existing house.

The prior art hurricane clips provide little lateral strength, even when using a left and right. Except for Thompson's retrofit hurricane clips, the prior art cannot tie the outside sheathing to the underlying top plate and roof rafter. They cannot clear frieze boards and prevent the outside sheathing from being sucked off during the extreme negative pressure of a hurricane.

The prior art inventions do not prevent the outside sheathing from splintering and disconnecting during earth tremors. They are difficult to retrofit onto existing homes.

Frye's anchor system, U.S. Pat. No. 5,311,708, is patented as a retrofit, but it does not tie the rafter to the top plate, cannot clear frieze boards, and ties into the weakest thin edge of the rafter while splitting it with bolts. Frye's 708 also provides no lateral support against side movements.

Netek's reinforcing tie, U.S. Pat. No. 5,257,483, is patented as a retrofit and may clear frieze boards, but it is temporary, and like Frye, ties into an even weaker thin edge of the end of the rafter. Netek's 483 also provides no lateral support against side movements.

There are several retrofit apparatus for securing roofs using cables. Adams U.S. Pat. No. 5,570,545 and Winger U.S. Pat. No. 5,319,896 are both temporary, meaning a homeowner must be home to deploy and anchor the ephemeral cables. The anchors can only be as secure as the nearby soil and the cables do not prevent the walls from bowing or blowing out.

There are a number of joist hangers that fasten to a joist and vertical member while a house is being constructed including: Colonias et al U.S. Pat. No. 5,104,252 and Gilb U.S. Pat. No. 4,480,941. These are good inventions, but they provide little lateral strength, and they are difficult to retrofit onto existing houses.

Joist hangers have a small ledge that supports all the weight from the joist beam. They hang the weight from the edge, rather than supporting the weight on top of the edge. They are also thin and parallel to the long dimension of the joist beam, concentrating all that carrying weight onto a vertical thin-section of the vertical member.

Gilb's complicated hanger, U.S. Pat. No. 4,261,155, is strong, but cannot be retrofit on to a house.

Prior art connectors relied on angled nailing, to provide lateral support, but the method was complex to manufacture, and very difficult to install on a completed house.

BACKGROUND OF INVENTION

Objects and Advantages

Accordingly, several objects and advantages of my invention are that it helps secure the roof to the wall of a building to make the building a solid unit and preventing it from being destroyed by hurricanes and earthquakes.

This invention helps prevent the roof from being blown off the walls of an existing building. It keeps the roof rafters and roof trusses tightly secured to the outside sheathing and underlying top plate of the wall.

This invention helps prevent the roof rafters and roof trusses from twisting during strong winds, thereby preventing detaching of the roof material and underlying roof sheathing. It stiffens the edge of the roof and the top of the wall, helping to transfer lateral loads to the whole roof and walls.

This invention helps prevent the wall sheathing of a building from detaching from the wall studs during an earthquake. It helps make the outside wall into a stable shear-wall, transferring shear forces into the foundation and ground.

One object of this invention is to make each outside wall on a house into a shear-wall, that is, able to transfer forces without breaking or disconnecting. By tying the outside sheathing securely to the top plate and rafter or roof truss, the plywood can reliably transfer and dissipate shear, lateral, and uplift forces to the ground.

During an earthquake or a hurricane, a building with my invention will be a sturdy unit, resisting and transferring destructive forces to the ground.

Many older homes were constructed with the best materials and competent carpenters, but used the time-honored method of connecting the rafter to the top plate with nails driven into the edge of the rafter. This weak connection, called toe-nailing, is still in use today to hold roof trusses to the top plate. Even if prior art hurricane clips were used in construction of a house, the homeowner can't tell, and those clips don't hold the outside wall sheathing to the wall.

Mounted on the roof rafter or roof truss, my invention resists uplift, the most destructive force during a hurricane. Mounted on the top plate and wall sheathing, my invention prevents the wall sheathing from being blown off or sucked out by the extreme negative pressure of a hurricane.

During an earthquake, when my clips are mounted on the roof and walls, they will make each member into a shear wall. The secured plywood will absorb and dissipate earth movements, without becoming detached from the underlying structural members. It will also prevent the sheathing from sliding past each other.

This would improve the house beyond existing building codes, as sheet metal joints have been proven to perform better than nailed joints during hurricanes and earthquakes.

Another object of this invention is the large surface area. This area prevents the outside sheathing from splitting during hurricanes or earthquakes. The large surface area provides more strength in the connecting or hold-down process.

Yet another advantage of this invention is during earthquakes, nails can sometimes bend with the movements of the house, but screws often break. This invention absorbs and transmits most of the forces during an earthquake and hurricane so nails and/or screws can be used as fasteners.

Another advantage is that since the invention absorbs and transfers earthquake and hurricane forces, less nails and nailing could be used. Also, screws could be used in the invention in earthquake areas with less fear that the heads will shear off.

Still another advantage of the invention is in the ability to prevent plywood sheets from sliding past or over each other during an earthquake. Previously, only nails had to shear, but this entire connector must be sheared for the invention to fail.

Still another advantage is that with the roof rafters and roof trusses better able to resist twisting, roof sheathing will stay firmly attached and roofing material will now have a better chance of staying on during strong winds and earth movements.

Earth tremors and hurricanes always destroy the weakest parts of a house. By making each envelope of a house, the vertical walls and roof envelope into a strong unit, there will be less damage.

It is a further object of this invention that it easily, quickly, and economically protects houses from the destructive forces of earthquakes and hurricanes. It is a still further object that the connectors and fasteners are strong, attractive, permanent, functional, uncomplicated, simple to manufacture, easy to install, and economical. All of the embodiments can be made from a single sheet metal blank, without any welding.

A further object is that this invention can be used on various size sheathing, rafters, roof trusses, studs, wood or metal I-beams, TJI, and glue-lams, all made from wood or metal. There may be insurance discounts for homeowners who have this invention installed on their houses.

As a retrofit, a handy homeowner can install this invention, or have it installed. The homeowner can easily see that the home is protected instead of wondering if hurricane clips were installed correctly during construction, or installed at all.

Traditional toe-nailing of the rafter is at the bird's-mouth, a notch cut into the rafter where it rests on the top plate. By cutting out material from the rafter, a bird's-mouth weakens the rafter. Toe-nailing only two nails from either side grasps only a small edge of the rafter, and the nail only extends into the top 2× of the top plate.

As a retrofit, an insurance agent can observe that the home is protected and give appropriate discounts. Perspective home buyers can perceive that the building is protected, so the seller has a good selling point and can ask for a better price.

Since these clips are a retrofit, and are not covered by sheathing or gypsum board, the invention is much thicker than prior hurricane clips and tensile values are dramatically increased.

Another advantage is with the top webs angled away from vertical, they form an upside-down flying buttress. This tremendously increases resistance to outward thrusts. This makes the roof much stronger and able to resist more weight such as thick snow, ice, or volcanic ash, and heavy roofing material such as tile, insulated roofing, solar collectors, and satellite dishes.

Since this invention cradles the rafter or roof truss on the side, and has a wide base anchored to the outside wall, torsional twisting of the rafter is significantly reduced over prior art hurricane clips, as is cross-grain splitting.

The left and right clips, that can be installed on opposite sides of the rafter, have offset nail holes. Nails driven into the rafter will be offset from each other lessening wood splitting and vastly increasing holding power.

This invention does not require any removal of frieze boards or wood trim from the house. On houses where a frieze board is installed between rafters or roof trusses, this invention has an ledge between the top and base webs that allows the invention to be installed as a retrofit. The offset clears any frieze board, wires, or trim that sticks out from the wall.

If the frieze board is warped or is slanted away from the house, the angled top web's position will clear it. If the frieze board is angled on one side of the rafter and straight on the other side of the rafter, this invention will still not be hindered in being retrofit on to a house.

Edges of the clip are slightly rounded for strength, ease of handling, and avoiding stress fracturing associated with sharp corners. Necking down of the center web, common on prior hurricane clips, is avoided on this invention.

These and other objectives of the invention are achieved by simple and economical connectors that allow a builder or home owner to quickly and easily secure the weakest parts of a building against earth tremors and high winds. The weakest parts being the rafter to top plate connection, and the attachment of outside wall sheathing.

Advantages of each will be discussed in the description. Further objects and advantages of my invention will become apparent from a consideration of the drawings and ensuing description.

SUMMARY

Innovative hurricane clips with unique sides, elongated bends, and multiple bends that were never used previously on hurricane clips. Hurricane clips that are easy to install, strong, and protect an existing home against wind and seismic events.

BRIEF DESCRIPTION OF THE DRAWINGS

FIG. 2C Top view of a seismic clip showing "W" bend.

Figure 1A:
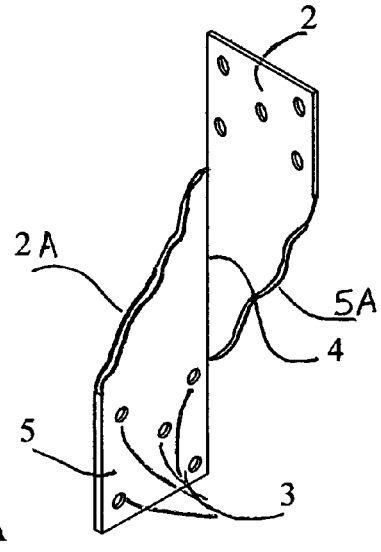
FIG. 1A Perspective view of a dynamic clip.

| Reference Numerals in Drawings | |
|---|---|
| 1. | Dynamic clip |
| 2. | Rafter web |
| 2A. | Left wavy side |
| 3. | Nail hole |
| 4. | Rafter bend |
| 5. | Plate web |
| 5A. | Right wavy side |
| 6. | Seismic clip |
| 7. | Rafter web |
| 8. | Nail hole |
| 9. | Plate web |
| 10. | Rafter bend |
| 11. | Plate bend |
| 12. | Middle bend |
| 13. | Earthquake clip |
| 14. | Rafter web |
| 15. | Nail hole |
| 16. | Plate web |
| 17. | Rafter bend |

-continued

| Reference Numerals in Drawings | |
|---|---|
| 18. | Plate bend |
| 19. | Middle bend |
| 20. | Retrofit clip |
| 21. | Plate web |
| 22. | Nail hole |
| 23. | Rafter web |
| 24. | Rafter bend |
| 25. | Plate bend |
| 26. | Middle bend |
| 27. | Ledge |
| F. | Frieze board |
| R. | Rafter or roof truss |
| S. | Wall sheathing |
| T. | Top plate |
| W. | Wall stud |

DESCRIPTION

The present invention is a sheet metal retrofit connector for joining wood members on a building, such as a roof rafter and outside wall sheathing. During a hurricane, it prevents the roof rafter from disconnecting from the outside wall sheathing, and underlying top plate by uplifting forces. This invention contains hurricane clips with unique sides, multiple bends, and elongated bends that were never used previously on hurricane clips.

The main focus of this new invention is to add material into the bend that connects the rafter attachment web, and the top plate attachment web. Material has been added to the bend from the attachment webs, making the bend longer and stronger. The bend has also been strengthened by adding parallel bends. Making the bend stronger makes the entire clip stronger.

This invention relates to retrofit hurricane clips that are easy to install, strong, and protect an existing home against wind and seismic events. The invention can also be used where structural members intersect, cross, or abut, such as at the rafter/top plate, wall stud/top plate, sill plate/wall stud, joist/sill plate, post/girder, corner posts, and other structural connections that have to be held together securely.

The dynamic clip 1 prevents the outside wall sheathing S from detaching or bowing out from negative pressure extremes generated by a hurricane. It also prevents the wall from bowing in when on the windward side of the hurricane.

The dynamic clip 1 prevents detachment and sliding of the outside wall sheathing S from lateral forces during an earthquake. This clip makes the outside wall sheathing W into an extremely stable shear wall; and ties the top plate T and roof rafter R securely to this shear wall making it resistant to most earth tremors.

Refer now to FIG. 1A which shows a perspective view of a dynamic clip 1. The rafter web 2 is connected to the plate web 5 by a right angle bend called the rafter bend 4. This bend places the rafter web 2 and plate web 5 at right angles to each other.

The rafter web 2 has nail holes 3 for attachment to a roof rafter R. The wavy sides 2A and 5A on the sides of the rafter web 2 and plate web 5, add extra material onto the right angle rafter bend 4. Extra material on the right angle bend adds strength to the dynamic clip 1.

The wavy sides 2A and 5A are complementary. Where the right wavy side 5A juts in toward the center axis of the rafter bend 4, the opposite side of the left wavy side 2A juts out. The upper part of the rafter bend 4 has extra material formed from the upper part of the left wavy side 2A. This extends the rafter bend 4 upward. This material came from directly across the rafter bend 4 from the upper part of the right wavy side 5A.

By moving material from the upper part of the right wavy side 5A to the upper part of the left wavy side 2A, the upper part of the rafter bend 4 gains material. Tests have shown that the stronger the right angle bend in hurricane clips, the stronger and more resistant to uplift and lateral forces. Conversely, material from the lower part of the right wavy side 2A has been added to the lower right wavy side 5A. This adds material to the lower part of the rafter bend 4.

The wavy sides 2A and 5A are smooth bends. This prevents stress fractures during manufacture as occurs to previous hurricane clips that have sharp angles next to the right angle bend. Bending a right angle during manufacturing work-hardens the clip. The added area along the rafter bend 4 adds strength to the clip.

Figure 1B:
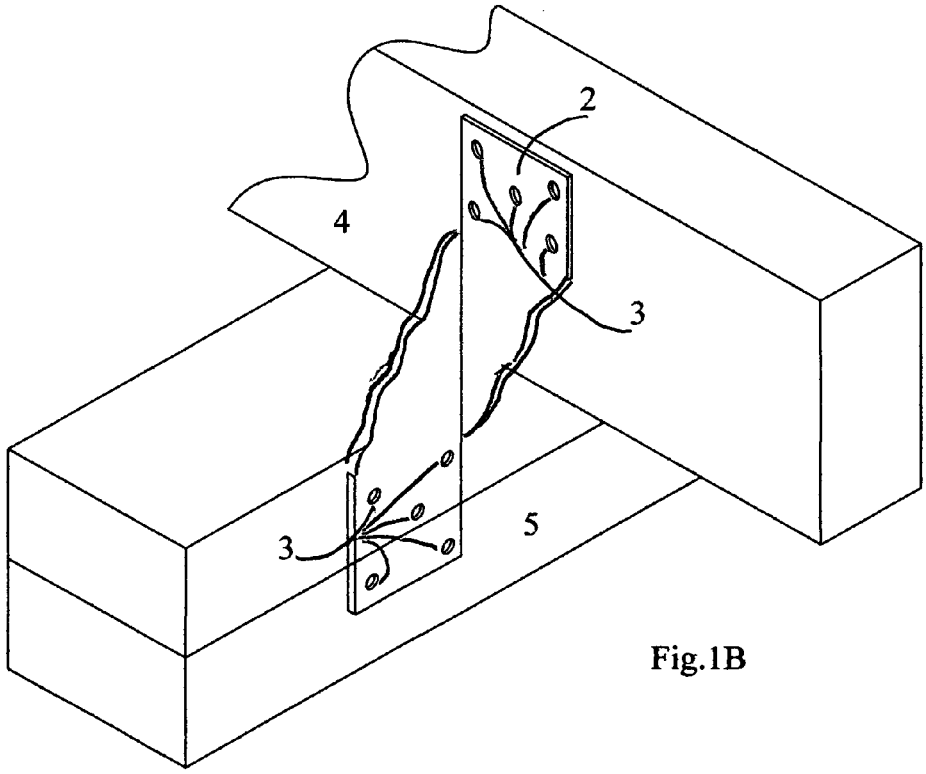
FIG. 1B Side view of a dynamic clip on a house.

Refer now to FIG. 1B which shows a side view of a dynamic clip 1 installed on a building. The rafter web 2 and right wavy side 5A are shown attached to a rafter R by nails in the nail holes 3. The added length of the right-angle rafter bend 4 is shown butting against the rafter R and top plate T attachment. By having more material along the right angle, the bond between each structural member is stronger.

The dynamic clip 1 is installed on a house by placing the rafter web 2 against the roof rafter R while placing the plate web 5 against the outside sheathing S or top plate T. The rafter bend 4 is adjacent to the rafter and top plate. Then nails or screws are used in the nail holes 3 to attach the webs 2 and 5 against the structural members of the house.

The edge of the left wavy side 2A and plate web 5 are shown attached to the top plate T. The long rafter bend 4 helps prevent uplift during a wind storm. This bend helps prevent twisting during a wind storm or seismic event. It also helps prevent any lateral movement during storms or seismic events.

Figures 1C, 1D:
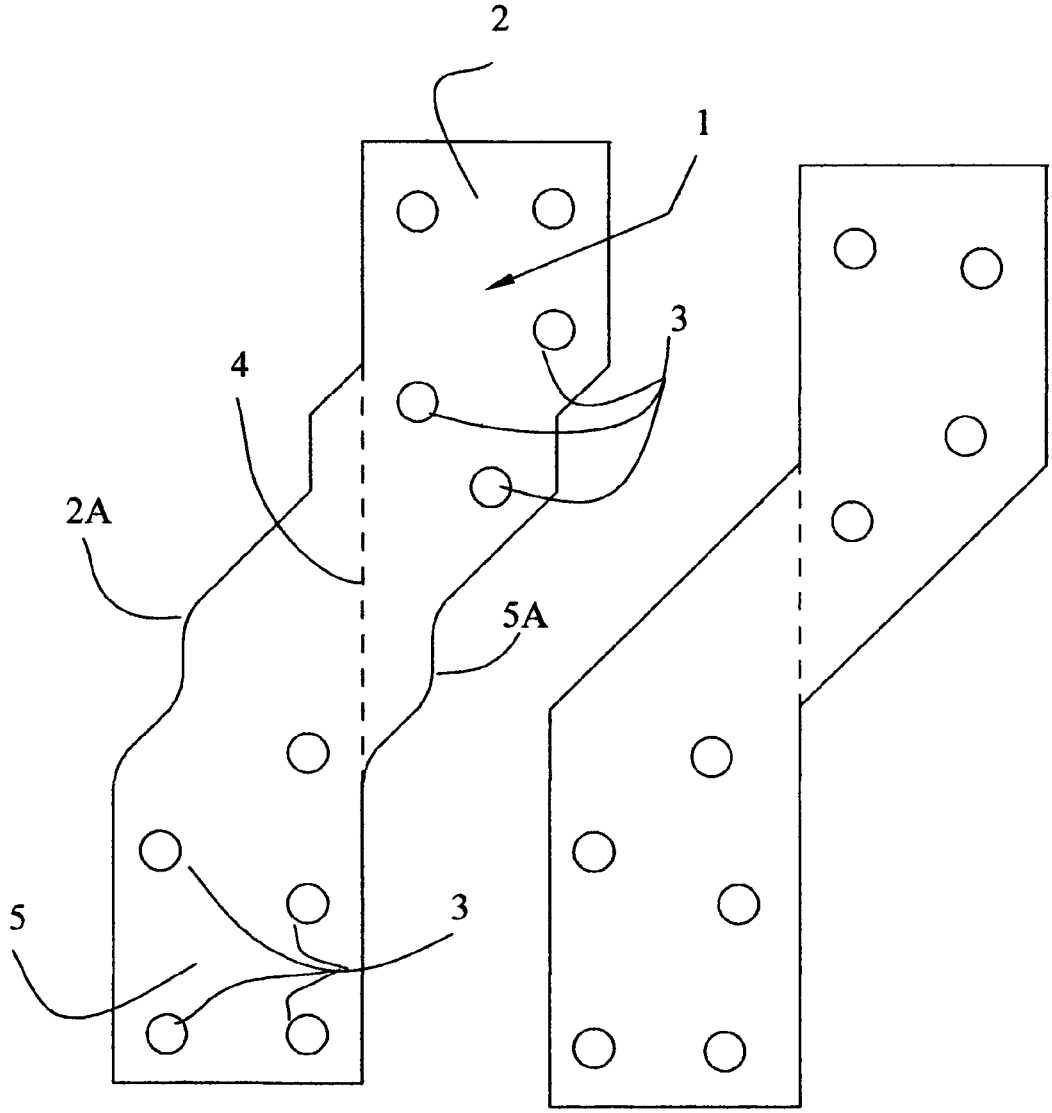
FIG. 1C Flat pattern layout of a dynamic clip.
FIG. 1D Prior Art, U.S. Pat. No. 4,714,372, FIG. 9.

Refer now to FIG. 1C which shows a flat pattern layout of a dynamic clip 1 before bending along the rafter bend 4. The rafter web 2, and plate web 5 have nail holes 3. The wavy sides 2A and 5A on the sides of the rafter web 2 and plate web 5, add extra material onto the right angle rafter bend 4.

The wavy sides 2A and 5A are complementary. The right wavy side 5A juts in toward the center axis of the rafter bend 4 and the opposite side of the left wavy side 2A juts out. The upper part of the rafter bend 4 has extra material formed from the upper part of the left wavy side 2A. This extends the rafter bend 4 upward. This material came from directly across the rafter bend 4 from the upper part of the right wavy side 5A.

By moving material from the upper part of the right wavy side 5A to the upper part of the left wavy side 2A, the upper part of the rafter bend 4 gains material and made stronger. Conversely, material from the lower part of the right wavy side 2A has been added to the lower right wavy side 5A. This adds material to the lower part of the rafter bend 4. The wavy sides 2A and 5A are smooth bends. This prevents stress fractures during manufacture as occurs to previous hurricane clips that have sharp angles next to the right angle bend.

Refer now to FIG. 1D which shows a Prior Art hurricane clip. This clip is from U.S. Pat. No. 4,714,372, FIG. 9. This flat pattern layout shows the short length of the axis of the right angle bend. Compare this to FIG. 1C. Both clips use the same amount of material, but the present invention has a bend axis that is almost twice as long as the prior art. Plus, the sides of the prior art have sharp bends, not smooth wavy sides. The present invention is much stronger while using the same amount of material. The wavy lines avoid the "notch effect".

Figure 1E:
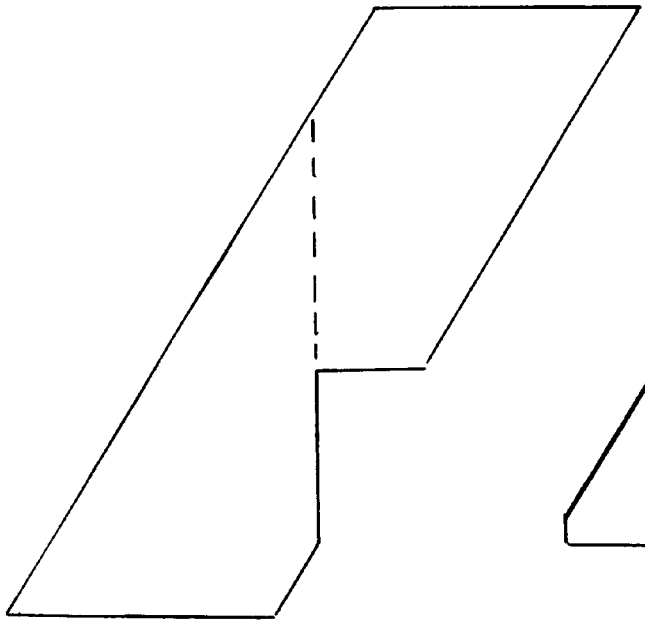
FIG. 1E Prior Art, U.S. Pat. No. 4,714,372, FIG. 8.

Refer now to FIG. 1E which shows a Prior Art hurricane clip. This clip is from U.S. Pat. No. 4,714,372, FIG. 8. This simple clip has a right angle bend that extends from the hypotenuse to the cut-in section on the bottom. This adds some extra length to the right angle bend.

Figure 1F:
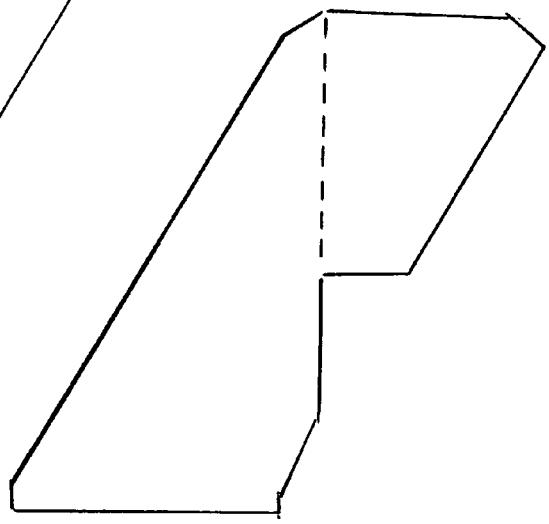
FIG. 1F Prior Art, U.S. Pat. No. 4,714,372, FIG. 7.

Refer now to FIG. 1F which shows a Prior Art hurricane clip. This clip is from U.S. Pat. No. 4,714,372, FIG. 7. This clip has a right angle bend that extends from the top of the clip to the cut-in section on the bottom. This adds more length to the right angle bend.

Figure 1G:
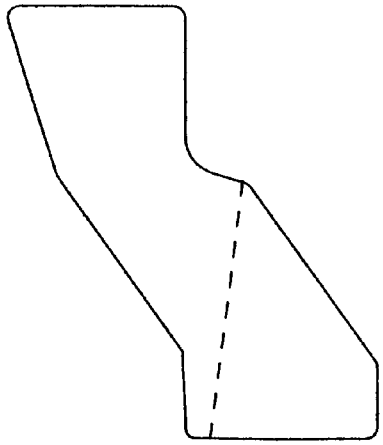
FIG. 1G Prior Art, patent application Ser. No. 11/904,719.

Refer now to FIG. 1G which shows a Prior Art hurricane clip. This clip is from application Ser. No. 11/904,719. This clip has a right angle bend that is offset. This adds even more length to the right angle bend.

Figure 1H:
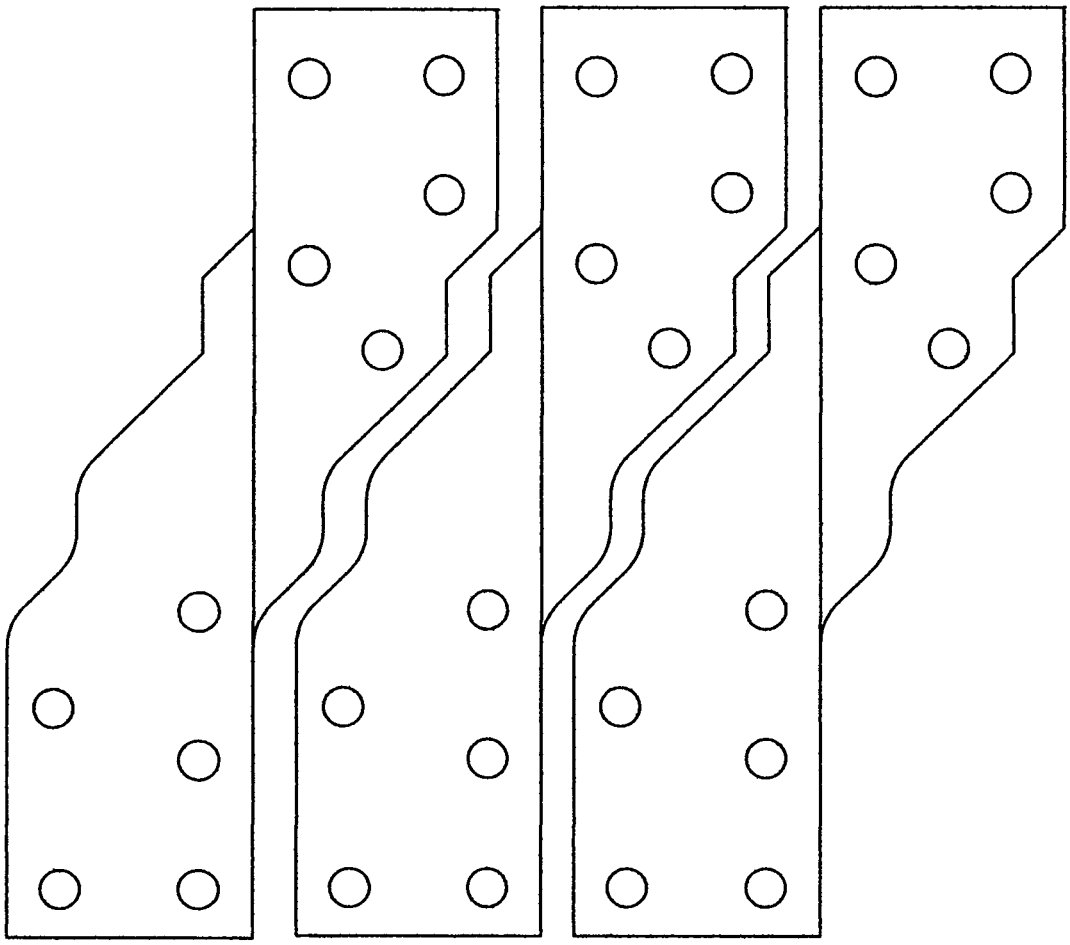
FIG. 1H Flat pattern layout of a dynamic clip showing nesting.

Refer now to FIG. 1H which shows nesting of the dynamic clip 1 during manufacture. The clips can be nested to each other so there is little waste during manufacture. The tool and die can stamp out the clips from a continuous sheet of material with little wasted material.

Figure 2A:
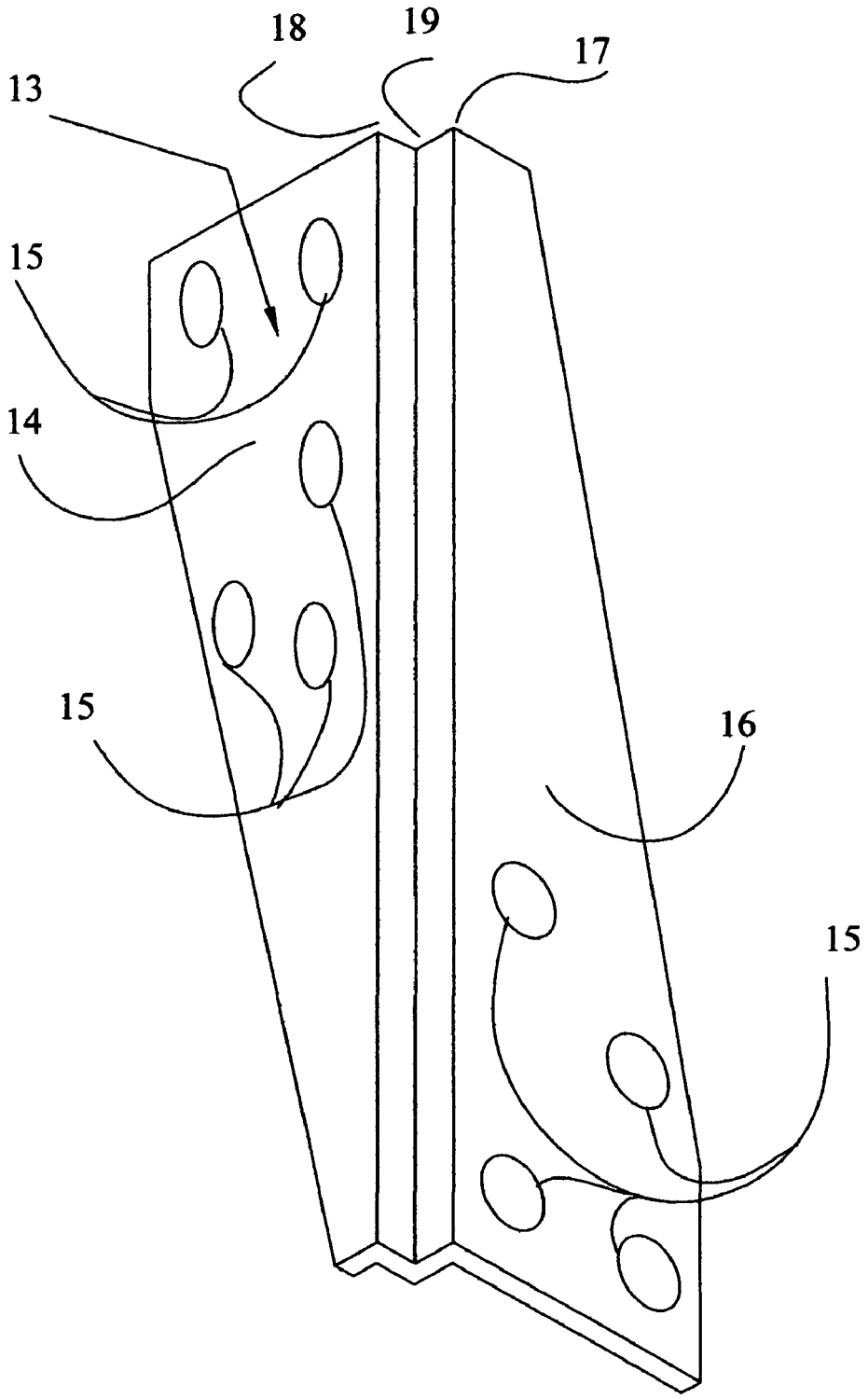
FIG. 2A Perspective view of seismic clip.

Refer now to FIG. 2A which shows a perspective view of a seismic clip 6. The seismic clip 6 has a rafter web 7 on top, and a plate web 9 on the bottom. Both webs are connected by three right angle bends 10, 11, and 12. The three bends are parallel. Having three bends adds extra strength to the bend, yet still has the rafter web 7 and plate web 9 at right angles to each other.

The rafter bend 10, plate bend 11, and middle bend 12 spreads out the right angle bend between the rafter web 7 and plate web 9. The more material is spread out, the stronger the load that can be carried. The seismic clip 6 has nail holes 8 for attaching the rafter web 7 to a rafter, and for attaching the plate web 9 to outside wall sheathing and the underlying top plate. The plate web 9 can also be attached to a top plate and wall stud.

Attaching a seismic clip 6 to the rafter R, and outside sheathing S and underlying top plate T of a house, ties the roof securely to the wall. This prevents uplift or detaching of the roof during strong winds. This also helps prevent detachment of the roof during lateral movement caused by seismic events. By securing the wall tightly to the roof, the roof is used as a buttress against lateral loads, as would occur during seismic events.

Figure 2B:
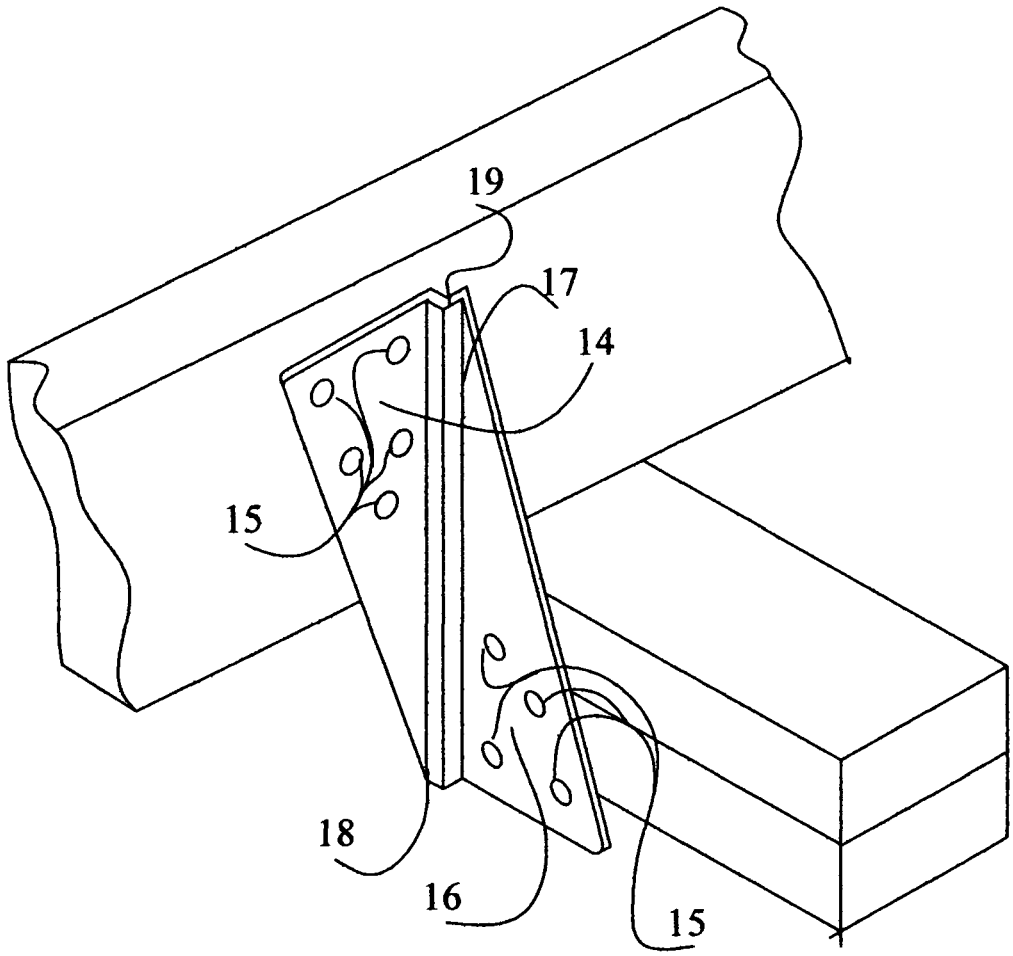
FIG. 2B Front view of a seismic clip on a house.

Refer now to FIG. 2B which shows a front view of a left and right seismic clip 6 attached to a building. The edge of each rafter web 7 is shown attached to a rafter R through nail holes 8. Each plate web 9 is shown attached to the outside sheathing S and underlying top plate T. The rafter bends 10 are against the rafter R, and the plate bends 11 are against the sheathing S. The middle bends 12 add extra material between the two outer bends, and braces the other bends.

The seismic clip 6 is attached to a building by placing the rafter web 7 against the roof rafter R while placing the plate web 9 against the outside sheathing S or top plate T. Then nails or screws are inserted into nail holes 8 into each structural member. The rafter bend 10 will be adjacent to the roof rafter R, the plate bend 11 will be adjacent to the top plate T, and the middle bend 12 will add strength between them.

Figure 2C:
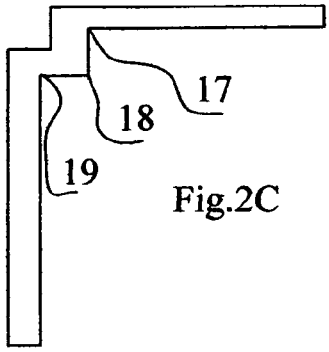

Refer now to FIG. 2C which shows a top view of the seismic clip 6. The three right-angle bends can be seen clearly between the rafter web 7 and plate web 9. The rafter bend 10 and plate bend 11 are bent in. The middle bend 12, connecting the rafter bend 10 and plate bend 11, is bent out. Bending a right angle during manufacturing work-hardens the clip. Adding extra parallel bends makes it into a folded plate which is much stronger.

There's an old bar bet about how to support a glass between two other glasses using a dollar bill. To win the bet, the dollar is folded in parallel, right-angle bends like an accordion. The folded bill is placed between the glasses and can now support several glasses. The right angle bends make the paper into a strong folded plate. This is similar to how multiple, parallel, right angle-bends in the seismic clip 6 make it stronger.

Figure 2D:
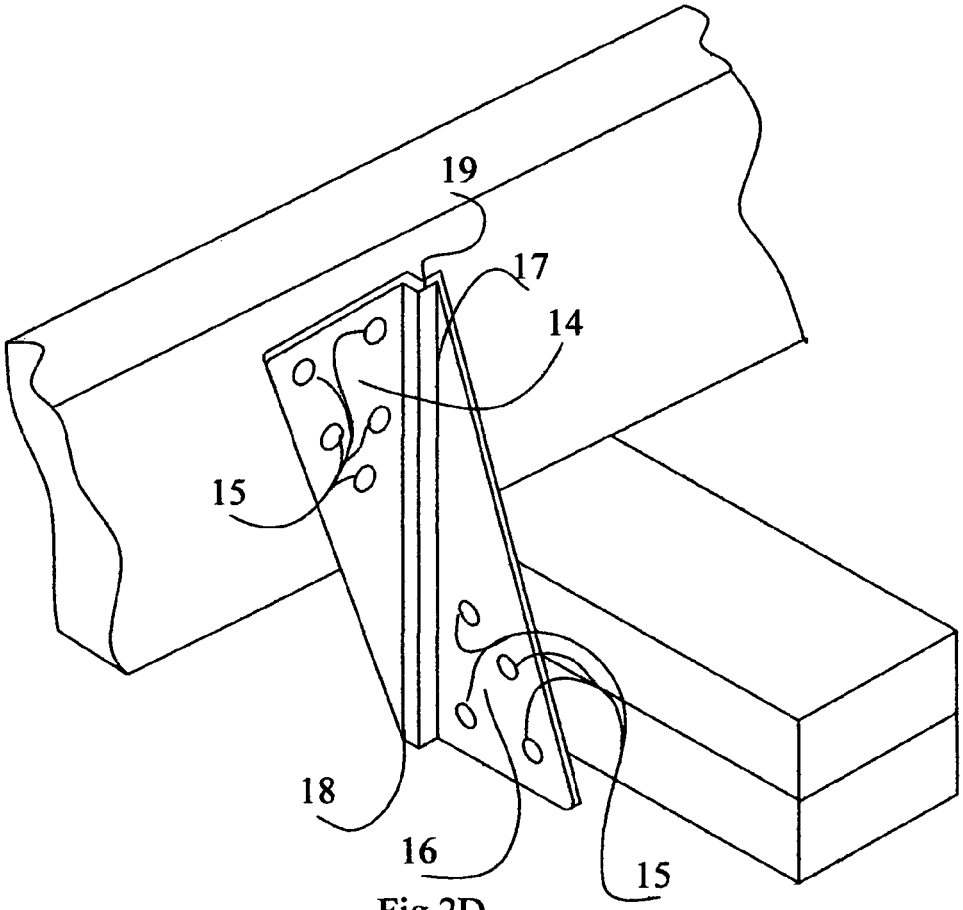
FIG. 2D Side view of a seismic clip on a house.

Refer now to FIG. 2D which shows a side view of a seismic clip 6 attached to a building. The rafter web 7 is shown attached to a rafter R through nail holes 8. The plate web 9 is shown attached to the outside sheathing S and underlying top plate T. The rafter bend 10 is against the rafter R, and the plate bend 11 is against the sheathing S. The middle bend 12 adds extra material between the two outer bends, and braces the other bends.

Figure 2E:
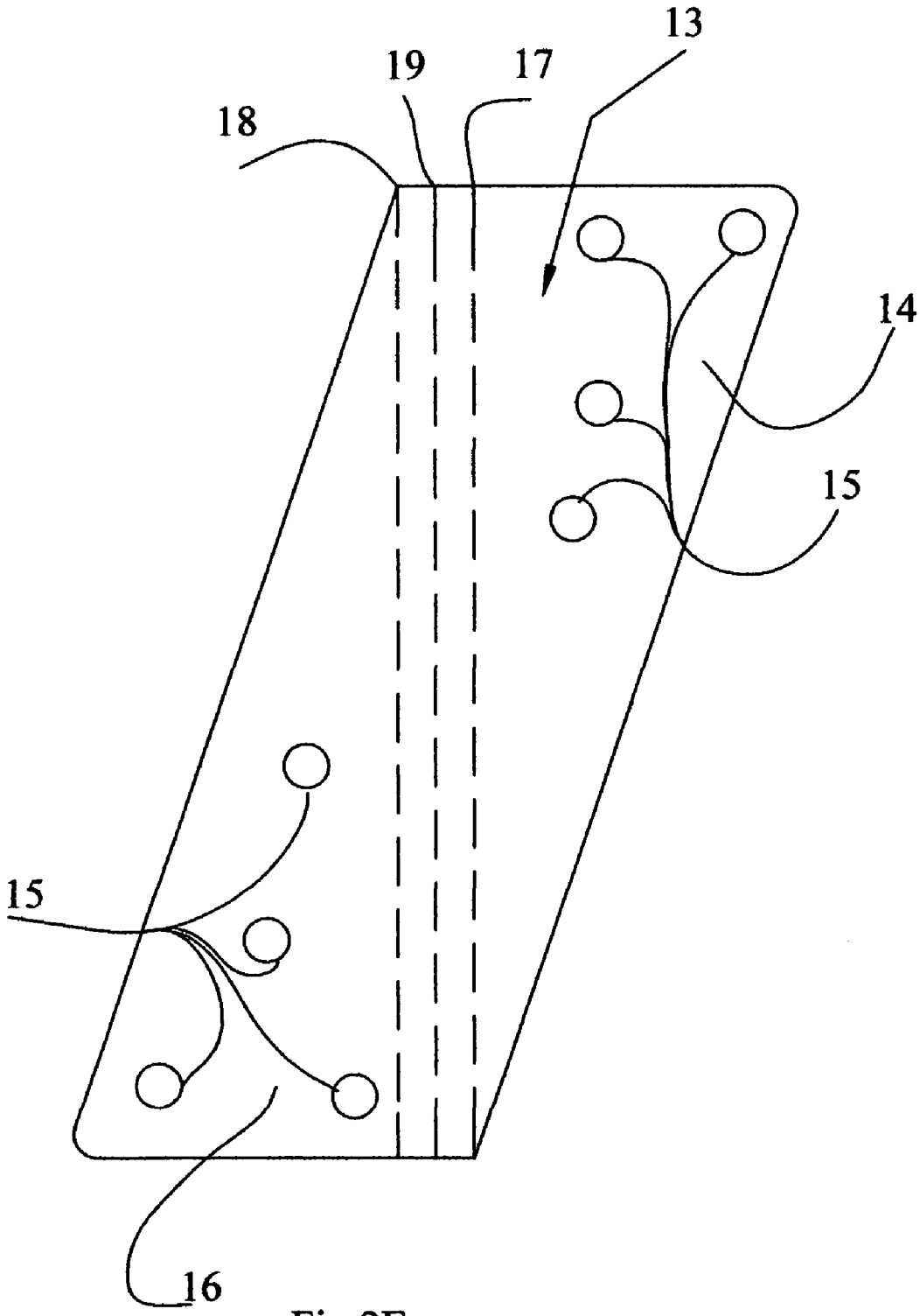
FIG. 2E Flat pattern layout of a seismic clip.

Refer now to FIG. 2E which shows a flat pattern layout of a seismic clip 6 prior to bending. The rafter web 7 is at the top and the plate web 9 is at the bottom. The three axises for the rafter bend 10, plate bend 11, and middle bend 12 are shown parallel to each other.

Figure 2F:
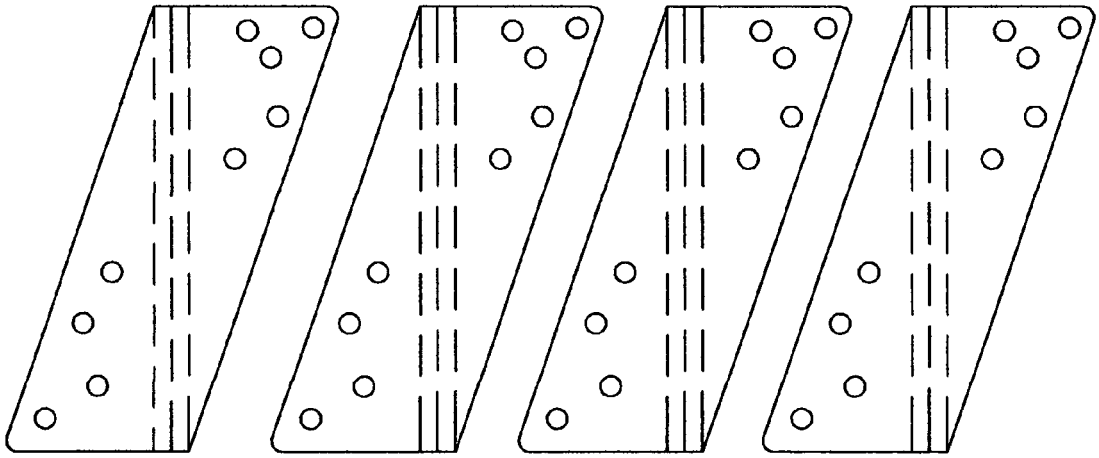
FIG. 2F Flat pattern layout of a seismic clip showing nesting.

Refer now to FIG. 2F which shows nesting of the seismic clip 6. It can be manufactured without wasting material. The seismic clips 6 nest next to each other thereby preventing wasted material.

Figure 3A:
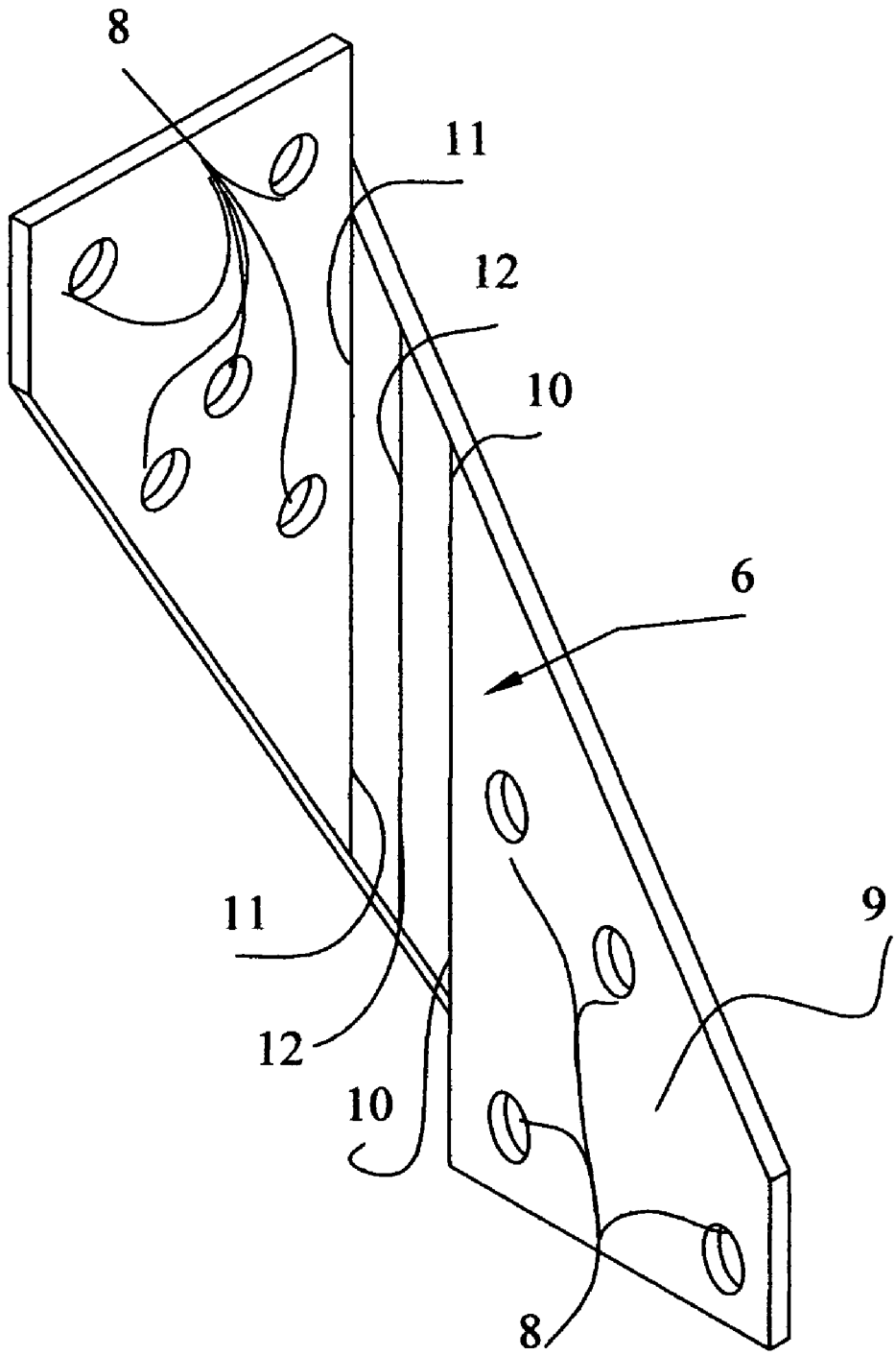
FIG. 3A Perspective view of an earthquake clip.

Refer now to FIG. 3A which shows a perspective view of an earthquake clip 13. The rafter web 14 is at the top and the plate web 16 is at the bottom. Connecting the rafter web 14 and plate web 16 are three parallel, right-angle bends. The rafter bend 17 and plate bend 18 are connected to the rafter web 14 and plate web 16 respectively. Connecting the rafter bend 17 and plate bend 18 is the middle bend 19.

The earthquake clip 13 is similar to the seismic clip 6, except the right-angle middle bend 19 is along the complete length of the earthquake clip 13. The rafter bend 17 starts at the top and extends almost to the bottom. The plate bend 18 starts at the bottom and extends almost to the top. Having three right-angle bends along most of the entire length of the clip adds tremendous strength.

Similar to a piano hinge, which is along most of the entire length of the piano, having the hinge or right angle along most of the entire length of the clip adds great strength. A clip could be made with just the right-angle middle bend 19. Having a single right angle bend along the entire length of the clip adds strength. But adding multiple, parallel bends like the rafter bend 17 and plate bend 18 adds more strength for the earthquake clip 13. The right-angle bends are similar to those shown in FIG. 2C.

Figure 3B:
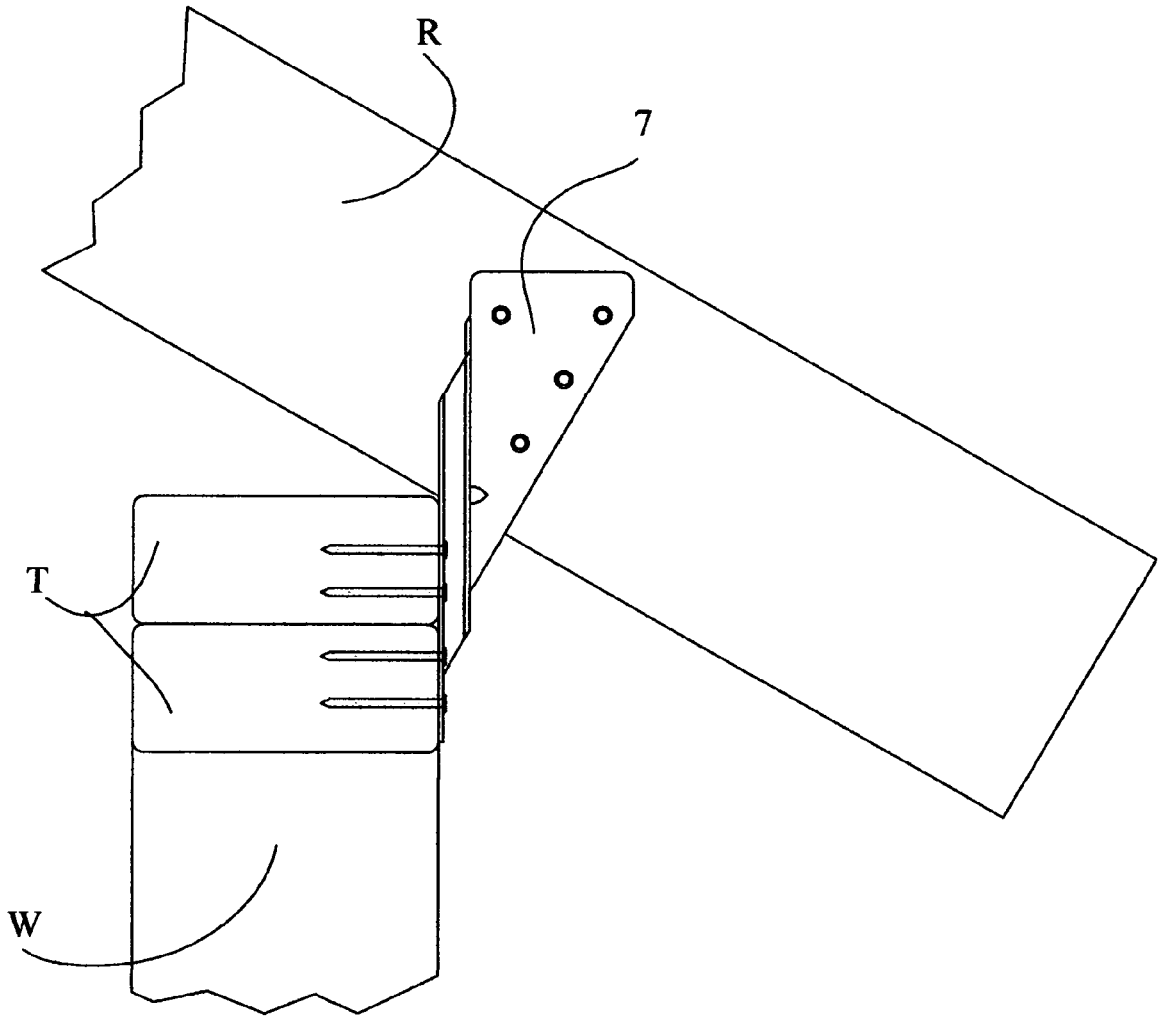
FIG. 3B Side view of an earthquake clip mounted on a house.

Refer now to FIG. 3B which shows a side view of an earthquake clip 13 mounted to a building. The edge of the rafter web 14 is shown attached to a rafter R through nail holes 15. The plate web 16 is shown attached to the outside sheathing S and underlying top plate T. The rafter bend 17 is against the rafter R, and the plate bend 18 is against the sheathing S. The middle bend 19 adds extra material between the two outer bends, and braces the other bends.

The earthquake clip 13 is attached to a building by placing the rafter web 14 against the roof rafter R while placing the plate web 16 against the outside sheathing S or top plate T. Then nails or screws are inserted into nail holes 15 into each structural member. The rafter bend 17 will be adjacent to the roof rafter R, the plate bend 18 will be adjacent to the top plate T, and the middle bend 19 will add strength between them.

Figure 3C:
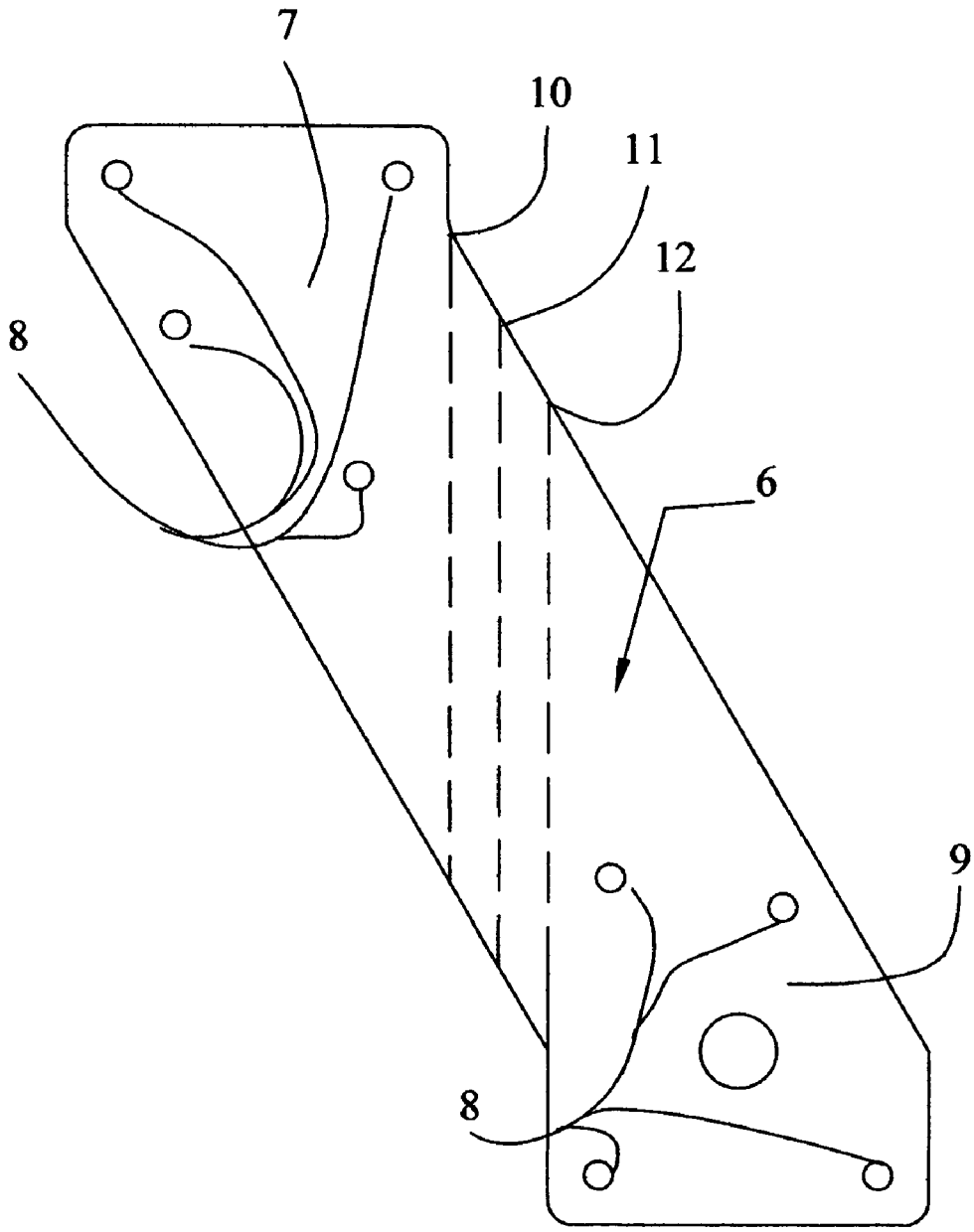
FIG. 3C Flat pattern layout of an earthquake clip.

Refer now to FIG. 3C which shows a flat pattern layout of an earthquake clip 13. The rafter web 14 is at the top and the plate web 16 is at the bottom. The three axises for the rafter bend 17, plate bend 18, and middle bend 19 are shown parallel to each other. The middle bend 19 extends from the top of the clip all the way to the bottom.

Figure 3D:
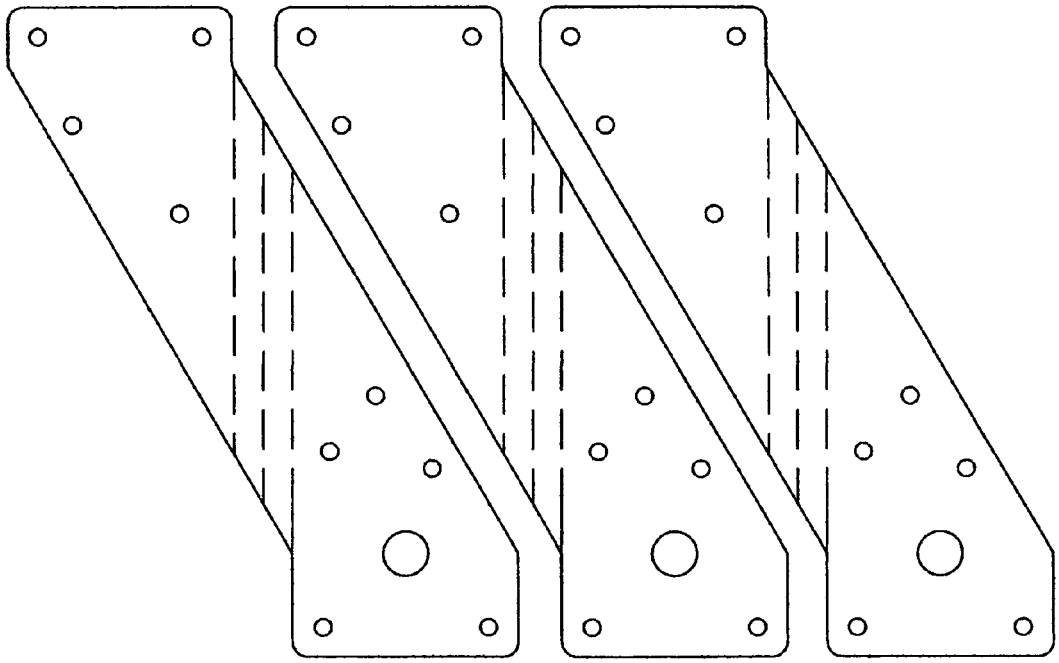
FIG. 3D Flat pattern layout showing nesting.
Figure 3F:
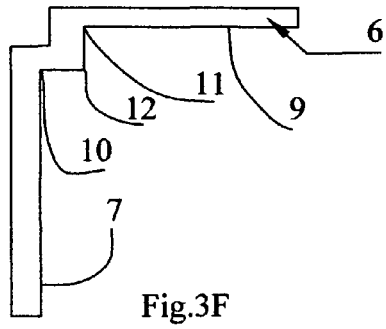
FIG. 3E Front left and right clips
FIG. 3F Top view showing "W"
FIG. 4A Perspective view of a retro clip.
Figure 3E:
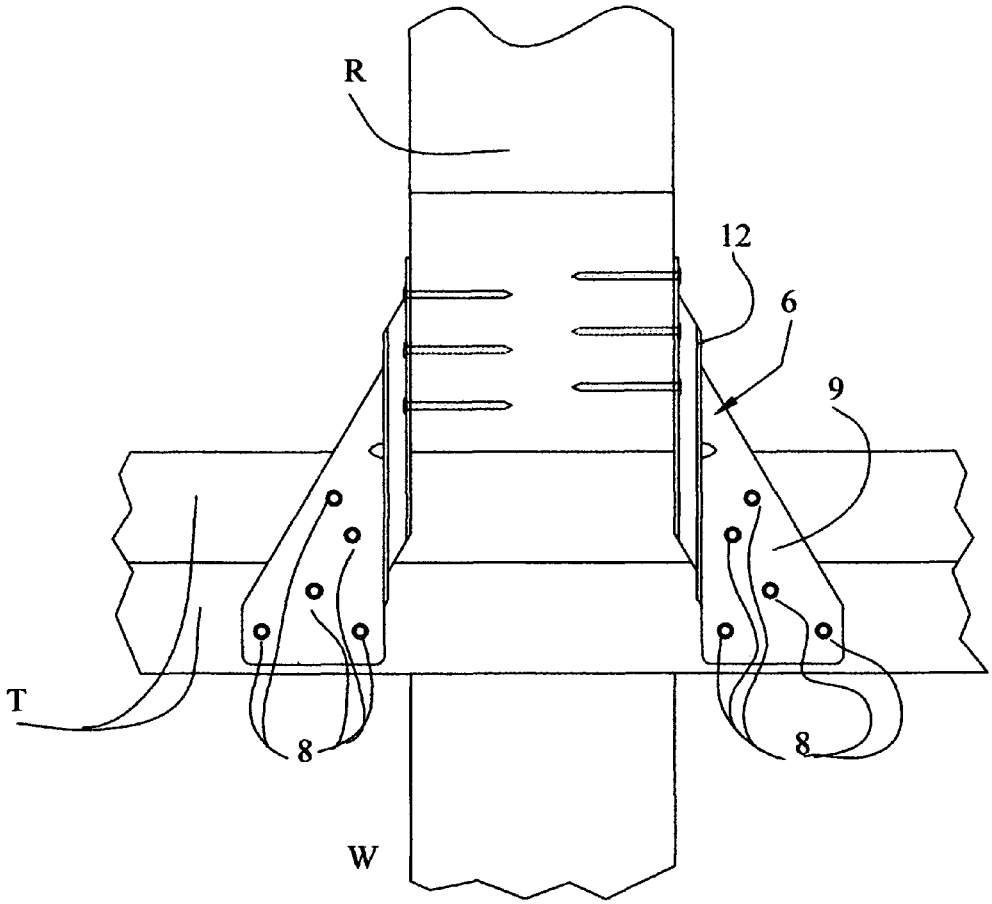

Refer now to FIG. 3D which shows nesting of the earthquake clip 13. It can be manufactured without wasting material. The earthquake clips 13 nest next to each other thereby preventing wasted material.

Figure 4A:
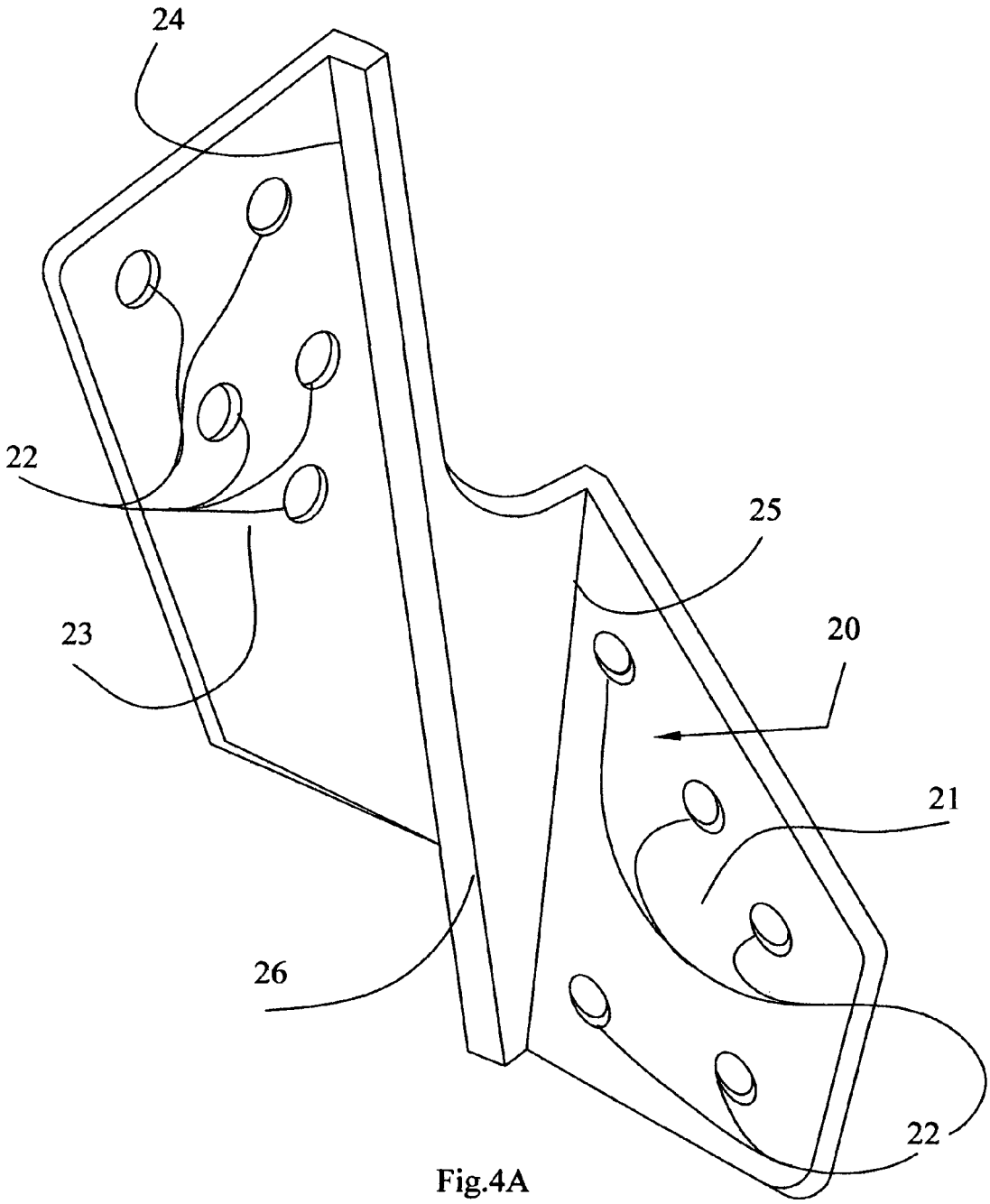
FIG. 4B Side view of a retro clip on a house.
FIG. 4C Flat pattern layout of a retro clip.
FIG. 4E Front view of retro clip
FIG. 4F Side view of retro clip

Refer now to FIG. 4A which shows a perspective view of a retro clip 20. The rafter web 23 is at the top and the plate web 21 is at the bottom. Connecting the rafter web 23 and plate web 21 are three converging, right-angle bends. The rafter bend 24 and plate bend 25 are connected to the rafter web 23 and plate web 21 respectively. Connecting the rafter bend 24 and plate bend 25 is the middle bend 26. A ledge 27, along the top of the three right-angle bends, forms a gently curved area for clearance of frieze boards or blocking on a house.

Figure 4B:
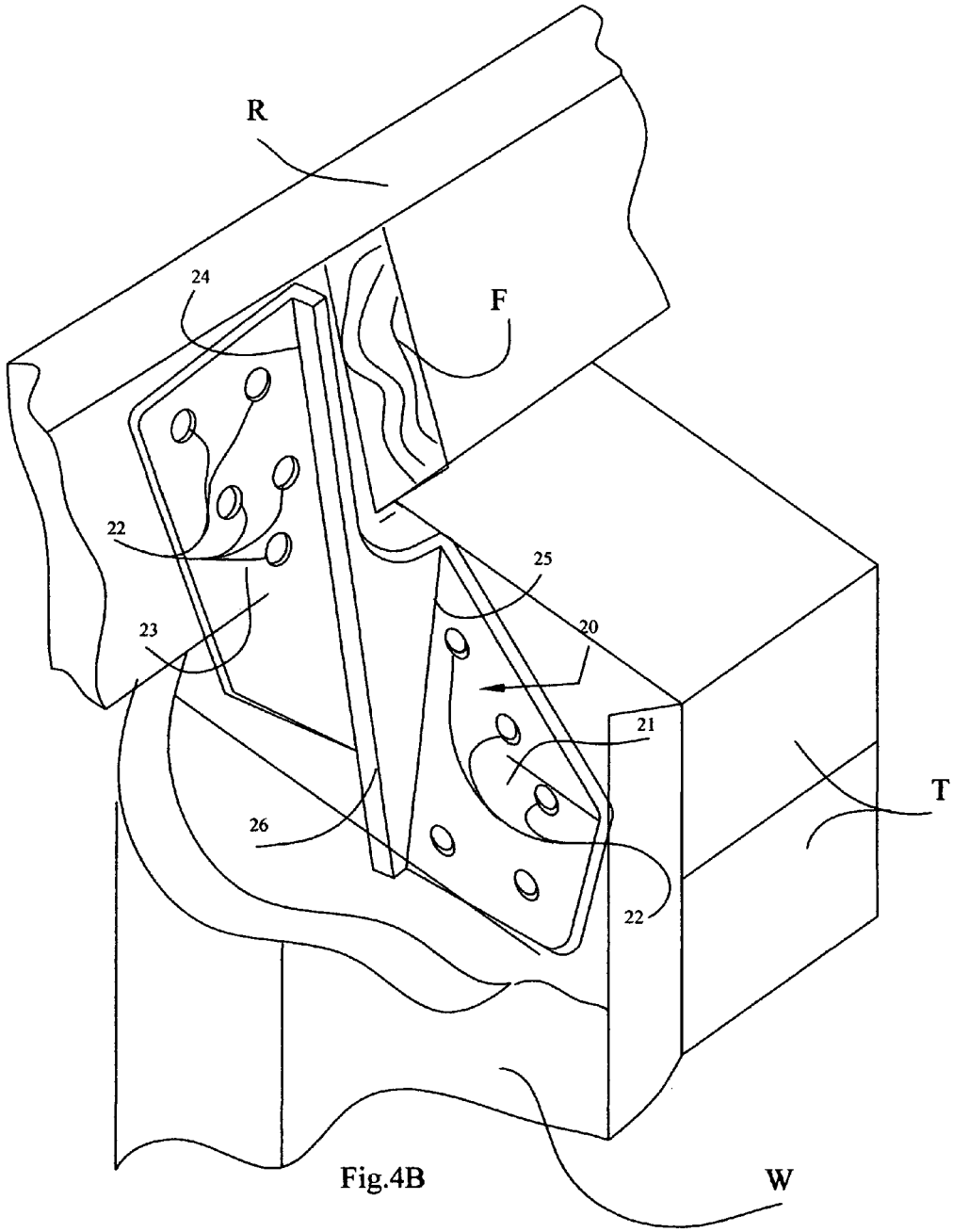

Refer now to FIG. 4B which shows a side view of a retro clip 20 attached to a house. The rafter web 23 at the top of the clip is attached to a rafter R through nail holes 22. The plate web 21 is attached to the outside wall sheathing S and underlying top plate T through nail holes 22. The rafter bend 24 is shown adjacent to the rafter R, and the plate bend 25 is shown adjacent to the sheathing S. The ledge 27 is adjacent to the bottom of a frieze board F, proving clearance around the frieze board F.

The retro clip 20 can be retrofitted to an existing home that has frieze boards or blocking between rafters. The frieze boards or blocking stick out past the outside sheathing. The retro clip 20 has the gently curved ledge 27 that clears the bottom of the frieze board or blocking and extends the rafter web 23 away from the frieze board or blocking, so no demolition is required for installation.

The retro clip 20 is attached to a building by placing the rafter web 23 against the roof rafter R while placing the plate web 21 against the outside sheathing S or top plate T. When a frieze board or blocking F is present, the ledge 27 will space the rafter web 23 past any part that sticks out. Then nails or screws are inserted into nail holes 22 into the rafter R and outside sheathing S and underlying top plate T. The rafter bend 24 will be adjacent to the roof rafter R, the plate bend 25 will be adjacent to the outside sheathing S, and the middle bend 26 will add strength between them.

Figure 4C:
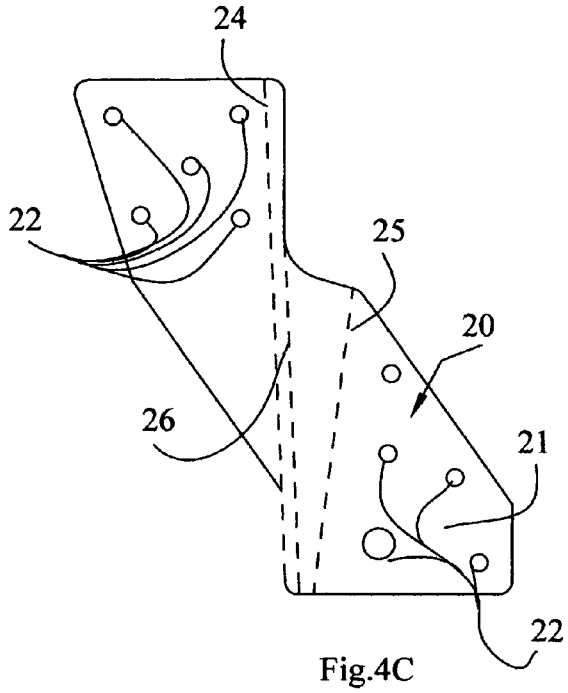
Figure 4E:
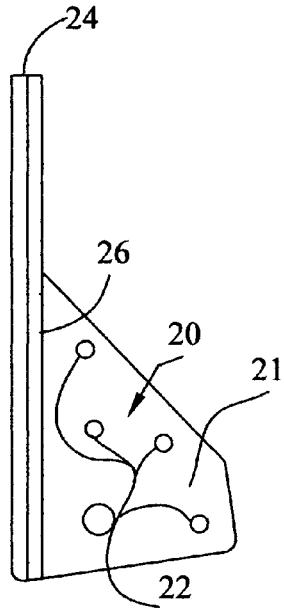
Figure 4F:
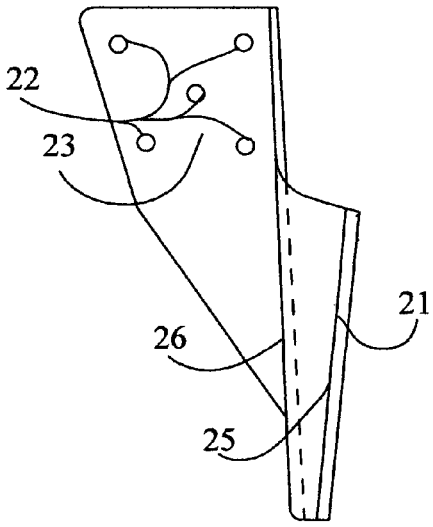

Refer now to FIG. 4C which shows a flat pattern layout of a retro clip 20. The rafter web 23 is at the top and the plate web 21 is at the bottom. The three axises for the rafter bend 24, plate bend 25, and middle bend 26 are shown non-parallel to each other. The gently-curved ledge 27 extends from the bottom of the rafter web 23, across the converging bends, to the top of the plate web 21.

Seismic activity can expose a building to many forces. One of the major forces is lateral movement caused by shaking. The long right-angle bends on these earthquake clips brace against in-and-out movement, or side-to-side bending. They also brace against upward movement as occurs during a hurricane or strong windstorm.

Most previous hurricane clips were made to be covered by sheathing and could not have any strengthening bends that were above the surface of their base web or rafter web. Their right angle bends had sheathing mounted flush against it. Since the present invention is mounted on the outside of a building, adding strength to the right angle bend can be performed with extra length and added bends. Things that were never thought of before.

The bends or folds do not have to be right angles. They can be at any acute angle that forms truncated pyramids, similar to steel decking, a wavy platform of steel often used as floors in steel buildings. The bends or folds do not have to be parallel. They can be converging, like an old, folding Japanese fan, as used in the retro clip. Forming bends or folds in the metal like the rafter bend, middle bend, and plate bend adds material to the bend and work-hardens the bend. This helps prevent the metal from bending against stress. Wind and seismic forces can apply stress to the clips from different directions, but the added length and bends help counteract this stress.

Bending and compressing metal in a tool and die work-hardens the metal. Forming multiple bends or folds in the metal helps strengthen the connection between the rafter web and plate web of a hurricane/seismic clip. The strong connection between the rafter web and plate web helps prevent uplift, lateral loading, twisting, and bowing out of the attached structural members. If the rafter spacing on the roof is wide apart, a left and right clip, mounted on either side of a rafter provide added strength to the rafter-wall connection.

CONCLUSION, RAMIFICATIONS, AND SCOPE OF INVENTION

The plate webs on each hurricane/earthquake clip are easily attached to the outside sheathing S with nails or screws. The wide rafter webs attached on either side of the rafter R provide plenty of room for hammering, hammer-gun, or electric screwdriver. If the outside walls are made of brick or masonry all the way up to the rafter, holes can be marked, drilled with a carbide drill, and inserted with lead-type anchors.

Sheet metal connectors have been proven to perform better than nailed connections under stresses of strong winds and earth tremors. This invention is very easily installed on a pre-existing house without disassembly or destruction of the house. If a soffit is located on the house, it is not structural, so it can be taken down and reinstalled when these hurricane/earthquake clips are installed. Once installed, the house is much stronger than just nailed connections and more sturdy than prior art connectors that are installed during construction of a building.

The invention can be easily installed as a retrofit at the weakest connection of a house, during a hurricane, the rafter R to outside wall sheathing S and underlying top plate T. This is also a weak connection during an earthquake, as the roof is heavier than the walls and moves at a different rate which can tear the roof from the walls.

Earthquakes can push a house upward and shake it side to side. The upward movement can detach the roof from the wall because it is heavier and would have more momentum. Side or lateral movement can detach or twist the rafters. These hurricane/earthquake clips prevent the rafter R from twisting, moving side-to-side, or detaching from the top plate T and outside wall sheathing S.

Many houses have been built with the outside wall sheathing S attached to the wall with staples or small nails. Many rafters R have been attached to the top plate T by toe-nailing, or driving nails at an angle into the thin edge of the rafter R and into the top plate T. This is a very weak connection Thin prior art hurricane clips were only connected to the rafter R and top plate T, and covered by the wall sheathing S.

The retro clip is a true retrofit on buildings that have frieze boards that stick out from a building. The dynamic clip, seismic clip, and earthquake clip are retrofits that fit on buildings that don't have frieze boards or blocking that sticks out from the wall. They help protect a house from the effects of hurricanes and earthquakes. All four clips hold the roof securely to the outside wall. They help prevent a roof rafter from lifting, twisting, moving in toward the house, moving out from the house, moving to the left, and moving to the right.

Each clip also hold the outside wall sheathing securely to the wall. They help prevent the outside sheathing from bowing out, bowing in, separating from the wall, riding over each other, and splitting.

Each clip turns the outside wall into a strong shear-wall and prevents the wall from racking. Each clip can be made with little waste of material.

Thus the reader can see that the hurricane/earthquake connectors of this invention are unique, strong, permanent, functional, and necessary. They are also simple and economical to make, requiring simple tool and dies and no welding.

The important bend between the rafter web and plate web has never been strengthened like the present invention. Having a long single bend, or having multiple bends makes an old hurricane clip into a strong and modern hurricane/earthquake clip.

This invention solves the problem of retro-fitting houses to minimize high wind and seismic dangers by using an ingenious and practical connector. Many homeowners stay in their house during hurricanes, because they do not want to be caught in traffic jams trying to escape the fury, or they live on a small island, or they are caught unaware.

While my above description contains many specificities, these should not be construed as limitations on the scope of the invention, but rather as an exemplification of one preferred embodiment thereof. Many other variations are possible.

The all important bend between the rafter web and plate web can be a single bend that goes from the top of the clip to the bottom. The bend can be multiple bends that go from the top of the clip to the bottom. Or the bend or bends can go part way. The bend can be a single right angle bend, multiple right angle bends, or multiple acute-angle bends. The bends can be sharp-edged, like a saw blade, or soft-edged, like the corrugations in cardboard. The multiple bends can be parallel or converging.

For example, since the connectors are on the outside of a building, the shape of the clip can be changed slightly to make them more architecturally appealing on certain types of houses. To fit on some architectural styles of houses, the shape can be changed slightly without comprising the structural integrity of the clip. The thickness of the connector can be altered or they can have beveled edges or chamfer.

Rubber, plastic, foam, or resilient pads could be inserted between the connector and the outside sheathing. This would help absorb the earthquake forces without cracking, and deaden the shocks, and after-shocks.

The invention could use different manufacturing techniques including manipulated sheet metal, casting, forging, extrusion, and plastic molds or injection. There can also be minor variations in color, size, and materials.

This invention was over-designed in order to exceed building codes in force or any that can be anticipated. Many areas have no codes for retrofit's because, prior to this invention, there were no workable ties that could be retrofit to most buildings. Lag bolts, nails, screws, bolts and washers, or epoxy could be used to fasten the connectors to the house.

I claim:

1. A one-piece connector for preventing hurricane and earthquake damage to a building comprising:

a. a flat rafter web;

b. a flat plate web;

c. said rafter web and said plate web connected perpendicular to each other;

d. said rafter web and said plate web connected by a plurality of adjacent right-angle bends;

e. the axis of each said right-angle bend is parallel to each other;

f. said plurality of adjacent, parallel, right-angle bends adds extra material to the connection between the rafter web and plate web;

g. said plurality of adjacent, parallel, right-angle bends work-hardens the extra material between the rafter web and plate web.

2. The connector of claim 1 wherein said rafter web and said plate web each having a substantially triangular-shape with the parallel right-angle bends forming contiguous sides of each said triangle.

3. The connector of claim 1 wherein said parallel and adjacent right-angle bends are folded into a W-shape, when viewed along the axises, whereby said W-shape uses minimum material and space to add extra strength to the right-angle bend.

4. The connector of claim 1 wherein said right-angled rafter web and adjacent plate web, each having a plurality of nail holes for attachment to a right-angled rafter and top plate of a house respectively, thereby preventing any rotation.

5. The connector of claim 1 wherein said connector having a substantially triangular shape and adjacent, parallel right-angle bends that allow the connectors to nest during manufacturing, thereby saving material.

6. The connector of claim 1 wherein said multiple, adjacent right-angle bends add material and work-hardens each right-angle bend, thereby bracing the connection between the rafter web and plate web, thereby adding strength and preventing bending and twisting between said webs, therein preventing wind and seismic damage to the building when said connector is attached to the rafter and top plate of the house.

* * * * *